US009435536B2

(12) United States Patent
Yokota et al.

(10) Patent No.: US 9,435,536 B2
(45) Date of Patent: Sep. 6, 2016

(54) GAS TURBINE COMBUSTOR EQUIPPED WITH HEAT-TRANSFER DEVICE

(71) Applicant: Mitsubishi Hitachi Power Systems, Ltd., Nishi-ku, Yokohama, Kanagawa (JP)

(72) Inventors: Osami Yokota, Tokyo (JP); Tomomi Koganezawa, Tokyo (JP); Shohei Numata, Tokyo (JP); Shohei Yoshida, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 397 days.

(21) Appl. No.: 14/070,093

(22) Filed: Nov. 1, 2013

(65) Prior Publication Data

US 2014/0230442 A1 Aug. 21, 2014

(30) Foreign Application Priority Data

Feb. 20, 2013 (JP) ..... 2013-030550

(51) Int. Cl.

*F23R 3/00* (2006.01)
*F23R 3/54* (2006.01)
*F23R 3/26* (2006.01)

(52) U.S. Cl.

CPC ..... *F23R 3/005* (2013.01); *F23R 3/54* (2013.01); *F05D 2260/2212* (2013.01); *F23R 2900/03044* (2013.01); *F23R 2900/03045* (2013.01)

(58) Field of Classification Search

CPC ..... F23R 3/54; F23R 3/002; F23R 3/06; F23R 2900/03043; F23R 2900/03045; F05D 2260/2212; F05D 2260/22141; F28F 13/12

See application file for complete search history.

(56) References Cited

U.S. PATENT DOCUMENTS 5,329,773 A * 7/1994 Myers ..... F23R 3/002 60/757
5,426,943 A 6/1995 Althaus et al.
5,738,493 A * 4/1998 Lee ..... F01D 5/187 415/115

(Continued)

FOREIGN PATENT DOCUMENTS

DE 3739619 A1 * 4/1988 ..... F28F 1/325
DE EP 0530721 A1 * 3/1993 ..... F02K 9/64

(Continued)

OTHER PUBLICATIONS

European Search Report issued in counterpart European Application No. 13191848.4, dated Jun. 12, 2015 (Six (6) pages).

*Primary Examiner* — Phutthiwat Wongwian
*Assistant Examiner* — Rene Ford
(74) *Attorney, Agent, or Firm* — Crowell & Moring LLP

(57) ABSTRACT

An object of the present invention is to provide a gas turbine combustor that can suppress an increase in pressure loss while improving product reliability. The gas turbine combustor includes a combustor liner, an air transfer casing installed on the outer circumference of the combustor liner, the combustor liner and the air transfer casing defining an annular passage therebetween adapted to allow a heat-transfer medium to flow therethrough, and a plurality of vortex generating devices disposed on an inside surface of the air transfer casing, the vortex generating devices generating longitudinal vortices each having a rotational axis extending in a flow direction of a heat-transfer medium. The plurality of vortex generating devices are arranged in paired manner, with each pair of devices generating vortices having rotational directions opposed to each other.

8 Claims, 14 Drawing Sheets

(56) References Cited

U.S. PATENT DOCUMENTS

| | | | | |
|---|---|---|---|---|
| 5,802,841 | A * | 9/1998 | Maeda | F23R 3/005 60/39.182 |
| 6,122,917 | A * | 9/2000 | Senior | F23R 3/002 165/908 |
| 6,578,627 | B1 * | 6/2003 | Liu | F28F 13/12 165/109.1 |
| 2002/0066273 | A1 * | 6/2002 | Kitamura | F23R 3/002 60/737 |
| 2005/0047932 | A1 * | 3/2005 | Nakae | F23R 3/002 417/313 |
| 2011/0016869 | A1 * | 1/2011 | Iwasaki | F23R 3/002 60/752 |
| 2012/0060504 | A1 | 3/2012 | Dugar et al. | |
| 2012/0067557 | A1 * | 3/2012 | Geskes | F28F 1/40 165/177 |
| 2012/0208141 | A1 * | 8/2012 | Siddagangaiah | F23R 3/002 431/350 |
| 2012/0272654 | A1 * | 11/2012 | Kaleeswaran | F23R 3/002 60/772 |
| 2013/0089434 | A1 * | 4/2013 | Simpson | F01D 5/187 416/97 R |
| 2013/0327057 | A1 * | 12/2013 | Cunha | F23R 3/002 60/782 |
| 2014/0290256 | A1 * | 10/2014 | Fujimoto | F01D 5/189 60/752 |

FOREIGN PATENT DOCUMENTS

| | | | | |
|---|---|---|---|---|
| DE | 19526917 | A1 * | 1/1997 | F01D 5/187 |
| EP | 0 896 193 | A2 | 2/1999 | |
| EP | 1 188 902 | A1 | 3/2002 | |
| EP | 1 936 468 | A1 | 6/2008 | |
| EP | 2 218 968 | A2 | 8/2010 | |
| JP | 62-131927 | A | 6/1987 | |
| JP | 4-116315 | A | 4/1992 | |
| JP | 6-221562 | A | 8/1994 | |
| JP | 9-196377 | A | 7/1997 | |
| JP | 2000-320837 | A | 11/2000 | |
| JP | 2001-280154 | A | 10/2001 | |
| JP | 3967521 | B2 | 8/2007 | |

* cited by examiner

GAS TURBINE COMBUSTOR EQUIPPED WITH HEAT-TRANSFER DEVICE

BACKGROUND OF THE INVENTION

1. Field of the Invention

The present invention relates to a gas turbine combustor equipped with a heat-transfer device.

2. Description of the Related Art

The background art of the present technical field is described in Japanese Patent No. 3967251 as below. "In a heat-transfer device for performing thermal exchange between an attachment member and a heat-transfer medium, longitudinal vortex generating devices are installed, which are configured to generate longitudinal vortices each having the rotational axis extending in the flow direction of the heat-transfer medium and to stir the heat-transfer medium flowing through the overall passage. The longitudinal vortices generating devices thus configured are installed in parallel in the flow direction of the heat-transfer medium, and between the longitudinal vortex generating devices thus installed in parallel, a plurality of turbulent-flow enhancement devices are installed, which break a boundary-layer occurring in the heat-transfer medium stirred by the longitudinal vortex generating device." The manufacturing method of the heat-transfer device mainly includes a process in which one end face of an attachment member having a short size is cut and then folded by means of a pressing machine, thereby forming longitudinal vortex generating devices and a process in which the attachment member is bent into a cylindrical shape. A plurality of the attachment members are manufactured and overlapped one on another to form a combustor liner. Thereafter, the turbulent-flow enhancement devices with rib configuration are installed on the outer circumferential surface of the combustor liner by welding or by blazing to complete the combustor liner.

The background art of the present technical field is described also in JP-62-131927-A. This publication describes "a cooling method which combines impingement jet cooling and cooling using projection fins". The background art of the present technical field is described also in JP-4-116315-A. This publication describes the fact that "the temperature distribution of a combustor liner is made uniform by changing the heat-transfer coefficient of fins". The background art of the present technical field is described also in JP-6-221562-A. This publication describes the fact that "the temperature distribution of a combustor liner is made uniform by changing the heat-transfer coefficient of fins". The background art of the present technical field is described also in JP-9-196377-A. This publication describes the fact that "a combustor liner structure which is provided with a spiral rib on the outer circumferential portion thereof, thereby maintaining necessary cooling performance with such a small pressure loss as not to impair the efficiency of the overall gas turbine and concurrently allowing for reduced combustion oscillation stress". The background art of the present technical field is described also in JP-2000-320837-A. This publication describes the fact that "guide fins are installed on the outer circumferential side of the liner and the inner circumferential side of the air transfer casing, thereby increasing flow velocity to achieve the improvement of a heat-transfer effect".

SUMMARY OF THE INVENTION

It is an object of the present invention to provide a gas turbine combustor that can suppress an increase in pressure loss while improving product reliability.

To solve the above problem, for example, a configuration described in claims is adopted.

According to an aspect of the present invention, there is provided a gas turbine combustor comprising: a combustor liner on an inner circumferential side; an air transfer casing on an outer circumferential side, the combustor liner and the air transfer casing defining therebetween an annular passage for a heat-transfer medium; and vortex generating devices disposed on an inside surface of the air transfer casing, the vortex generating devices each generating vortices or longitudinal vortices each having a rotational axis extending in a flow direction of the heat-transfer medium.

According to the combustor liner on the inner circumferential side and the air transfer casing on the outer circumferential side which define the annular passage therebetween, preferably, vortex generating devices for generating vortices or longitudinal vortices each having a vortex having a rotational axis extending in the flow direction of the heat-transfer medium are installed on the inside surface of the air-transfer casing. In addition, turbulent-flow enhancement devices for breaking a boundary-layer occurring in the heat-transfer medium are installed on the outside surface of the combustor liner.

Preferably, the vortex generating devices for generating vortices or longitudinal vortices each having a rotational axis extending in the flow direction of the heat-transfer medium are formed on the surface of an attachment member by a forming process. Then, after the attachment member is bent into a cylindrical shape, the cylindrical attachment member is inserted into the inner circumferential side of the air transfer casing. Thus, the vortex generating devices are formed on the inside surface of the air transfer casing.

Preferably, impingement jet cooling holes are added on the air transfer casing provided with the vortex generating devices at a position downstream of the vortex generating devices.

Preferably, the vortex generating devices forming rows installed in parallel to each other are installed in the axial direction such that their installation phases are changed for each row.

The present invention can provide a gas turbine combustor that can suppress an increase in pressure loss while improving product reliability.

DESCRIPTION OF THE PREFERRED EMBODIMENTS

Figure 1:
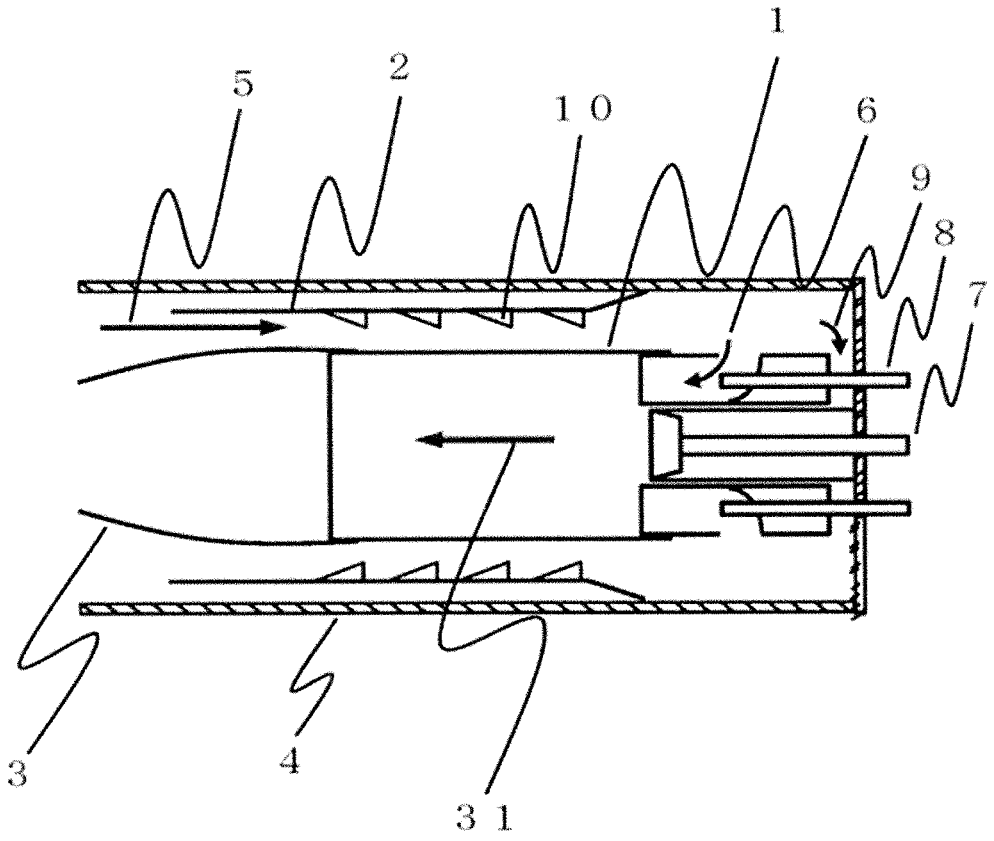
FIG. 1 is a cross-sectional view of a gas turbine combustor equipped with a heat-transfer device on the inside surface of an air transfer casing according to a first embodiment.

Preferred embodiments of the present invention described below relate to gas turbine combustors equipped with a heat-transfer device. In particular, the embodiments relate to a gas turbine combustor equipped with a device that enhances heat-transfer between fluid and an attachment member due to forced convection, i.e., a heat-transfer device that allows a heat-transfer medium to flow along the surface of the attachment member and performs heat exchange between the attachment member and the heat-transfer medium.

For forced convection heat transfer, enhancement of heat-transfer needs to suppress an increase in pressure loss in order to improve efficiency. For example, to improve the efficiency of a gas turbine, it is necessary to increase the temperature of combustion gas. Along with the increased temperature of combustion gas, it is needed to enhance the cooling of a liner. However, a method of further enhancing cooling needs to avoid an increase in pressure loss. Under such situations, impingement jet cooling may increase in pressure loss along with the increased jet flow velocity in some cases. In addition, fin cooling tends to increase in pressure loss along with the increase number of fins. Enhancement of turbulent flow using ribs has a small pressure loss; however, it is not expected to substantially improve cooling performance even if an interval between the ribs is narrowed. Therefore, the cooling enhancement resulting from the increased number of the ribs has a limit.

Because of this, a large number of combustor liners equipped with a heat-transfer device have been proposed to achieve an improvement in heat-transfer coefficient while suppressing an increase in pressure loss. One of the specific examples is a combustor liner that is provided, on the outside surface thereof, with plate-like vortex generating devices and turbulent-flow enhancement devices with rib configuration. With this, cooling performance is improved with a small pressure loss. The basic structure of such a technology is such that the heat-transfer device is installed on the surface of the combustor liner which is located on a higher-temperature side. Therefore, the number of component parts to be attached to the surface of the combustor liner and the number of welding places are increased. Thus, due to increased manufacturing costs and from the view point of thermal strength, a high cost and much time are required to secure product reliability.

JP-2000-320837-A discloses a specific example in which guide fins are installed on each of the outside surface of a combustor liner and the inside surface of an air transfer casing. The combustor described in JP-2000-320837-A is basically structured such that the sectional area of an annular passage defined between the combustor liner and the air transfer casing is narrowed or reduced by the installation of the guide fins. In this way, the flow velocity of passing air, i.e., of a passing heat-transfer medium is increased, thereby achieving an improvement of a heat-transfer effect. However, the increased flow velocity increases a pressure loss, which contributes to the lowering efficiency of the overall gas turbine.

Considering these circumferences, a heat-transfer device for equipment is provided, which suppresses an increase in pressure loss while improving product reliability. For example, one of the equipment is equipped with vortex generating devices which are configured to maintain necessary cooling performance with a pressure loss at which the lowering of the gas turbine efficiency is suppressed at a minimum level and to improve the reliability of structural strength. In addition, the vortex generating devices are configured to increase premixed combustion air to achieve low-NOx and also to improve heat-transfer performance, i.e., a cooling effect more.

According to a more specific example, a gas turbine combustor equipped with a heat-transfer device includes a combustor liner which defines an inner circumferential side of an annular passage for a heat-transfer medium and an air transfer casing which defines an outer circumferential side of the annular passage for a heat transfer medium; wherein the outer circumferential side air transfer casing is provided, on its inside surface, with vortex generating devices each for generating vortices, specifically, longitudinal vortices each having a rotational axis extending in the flow direction of the heat-transfer medium.

According to another specific example, for a combustor liner which defines an inner circumferential side of an annular passage and for an air transfer casing which defines an outer circumferential side of the annular passage; the air transfer casing is provided, on its inside surface, with vortex generating devices each for generating vortices, i.e., longitudinal vortices each having a rotational axis extending in the flow direction of a heat-transfer medium; in addition, the combustor liner is provided, on its outside surface, with turbulent-flow enhancement devices for breaking a boundary-layer occurring in the heat-transfer medium.

According to still another specific example, vortex generating devices each for generating vortices, i.e., longitudinal vortices each having a rotational axis extending in the flow direction of a heat-transfer medium are formed in the surface of an attachment member by a forming process, and after the attachment member is bent into a cylindrical shape, the cylindrical attachment member is inserted into the inner circumferential surface of the air transfer casing. Thus, the vortex generating devices are formed on the inside surface of the air transfer casing.

According to still another specific example, impingement jet cooling holes are additionally formed at a position downstream of vortex generating devices installed on an air transfer casing.

According to yet another specific example, vortex generating devices forming rows installed in parallel to each other are installed in an axial direction such that their installation phase are changed for each row.

With the configurations as described above, the heat-transfer device is installed on the inside surface of the air transfer casing; therefore, an increase in pressure loss can be suppressed while improving product reliability. Because of the reduced number of component parts to be mounted on the combustor liner, the number of welded places can be reduced. Therefore, an improvement in the reliability of the combustion liner and the longer operating life along therewith can be achieved. The reduced number of the welded places can suppress also the deformation of the combustor liner. Further, the vortex generating devices are installed on the inside surface of the air transfer casing. Therefore, the flexibility of mounting of the turbulent-flow enhancement devices installed on the outside surface of the combustor liner is increased, thereby achieving an improvement of a local cooling effect.

Specific embodiments of the present invention will hereinafter be described with reference to the drawings. Incidentally, the present invention is widely applied to equipment provided with a heat-transfer device; however, a gas turbine combustor which is used in a high-temperature state and has flow in a turbulent flow field is described as a main example.

Figure 14:
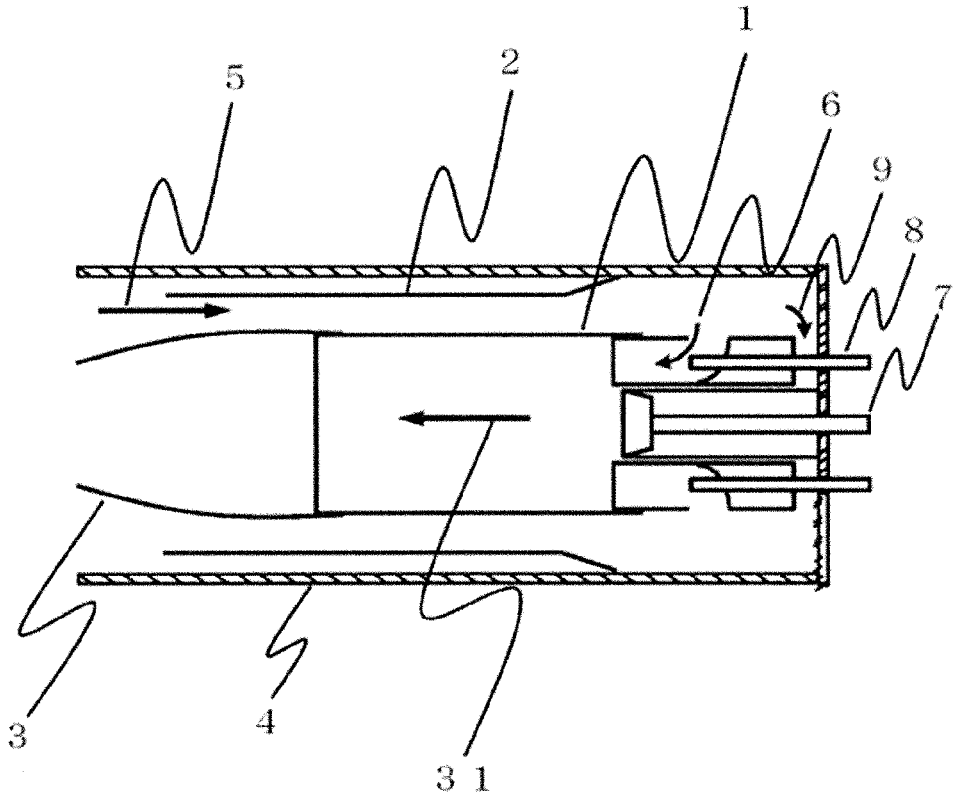
FIG. 14 is a cross-sectional view of a conventional gas turbine combustor.

FIG. 14 illustrates a cross-section of a gas turbine combustor. The combustor is configured to mainly include a combustor liner 1, a transition piece 3 and an air transfer casing 2, which are accommodated in a casing 4. A nozzle 7 for diffusion burning is disposed at an upstream end central portion of the combustor with annular nozzles 8 for premixed burning are disposed on the outer circumference thereof. The combustor liner 1 and the air transfer casing 2 have a substantially concentric dual cylindrical construction with an annular passage defined therebetween by making the diameter of the air transfer casing greater than that of the combustor liner.

Air 5 which is a heat-transfer medium flows through the annular passage. Specifically, the heat-transfer medium, or air 5, supplied from a compressor is used as fluid for cooling the combustor liner 1 while flowing through the annular passage between the combustor liner 1 and the air transfer casing 2. Thereafter, the heat transfer medium is supplied into the combustor liner while being divided into air 6 for premixed burning and air 9 for diffusion burning, which are each used as air for burning. Combustion gas 31 passes through the inside of the combustor liner 1 and is supplied to a turbine via the transition piece 3.

Figure 13:
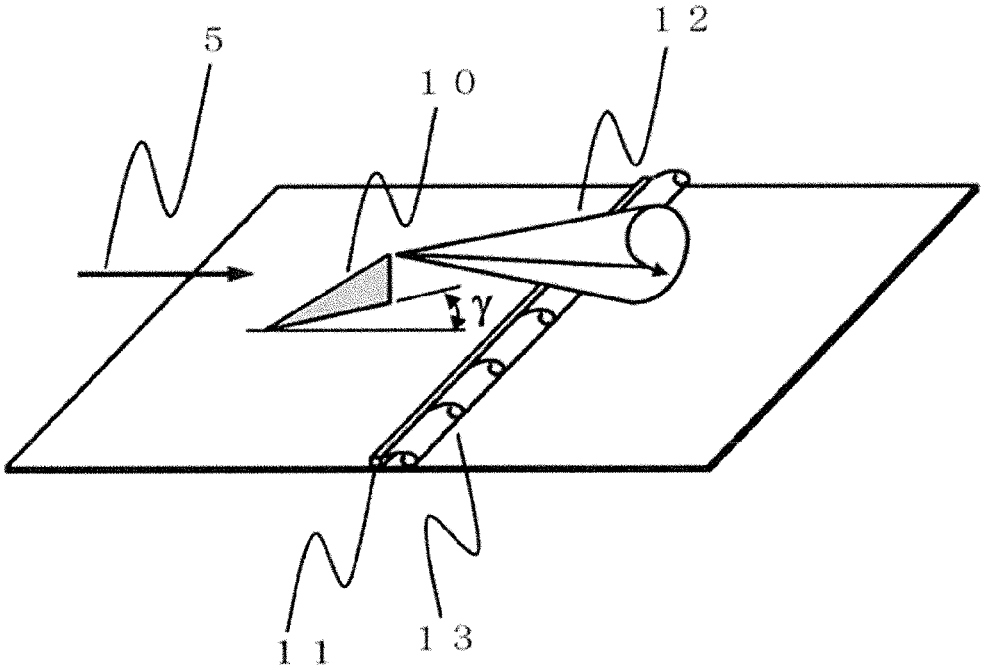
FIG. 13 illustrates the streamlines of a vortex generating device and a turbulent-flow enhancement device and the concept of heat-transfer enhancement.

FIG. 13 illustrates streamlines of a vortex generating device 10 and a turbulent-flow enhancement device 11 which are concerned with each of embodiments and a concept of enhancement of heat transfer. The vortex generating device 10 is composed of a plate-like projecting portion projecting from a surface on the side where the heat-transfer medium flows. The projecting portion has a given elevation angle $\gamma$ with respect to the main flow direction of the heat-transfer medium. Therefore, a longitudinal vortex having a rotational axis extending in the flowing direction occurs, and while the heat-transfer medium, or air 5, in the passage are largely stirred by the longitudinal vortices thus formed, it flows toward the downstream.

Flowing of the heat-transfer medium while being largely stirred performs, considering a case of e.g. a gas turbine combustor, exchange of heated air and cool air by longitudinal vortices if a vortex generating device is installed in the annular passage defined between the combustor liner and the air transfer casing. As a result, the heat-transfer medium with low temperature will constantly be supplied to the surface of the combustor liner. Thus, convection cooling on the surface of the combustor liner can efficiently be performed.

Further, since a long axis direction of a turbulence-flow enhancement device 11 installed on the surface of the combustor liner is made to intersect the main stream direction of the heat-transfer medium, separation vortices occur near the wall surface of the combustor liner. These separation vortices have a large effect of breaking the boundary-layer of the heat-transfer medium occurring close to the wall surface. Therefore, the combination use of the turbulent-flow enhancement device and the vortex generating device provides a larger cooling-enhancement effect. The height h of the turbulent-flow enhancement device 11 is determined with consideration of the liner re-adhesion distance of a separation vortex.

In general, it is qualitatively known that the re-adhesion distance L=10h (ten times the height). Therefore, it is basically assumed that the height h of the turbulent flow enhancement device 11 in each embodiment of the present invention is about one to several millimeters. Additionally, it is assumed that the vortex generating device 10 is formed to have an elevation angle $\gamma$ of 10° to 20° and a height H of ¼ to ½ of the passage through which the heat-transfer medium passes.

The descriptions of the overall configuration of a gas turbine and of detailed operation of a combustor including fuel nozzles are omitted in each of embodiments. Instead, the contents of Japanese Patent No. 3967521 should be referred to. The air transfer casing is a cylindrical structure which is installed on the outer circumferential side of the combustor liner in order to adjust the flow velocity and drift of air to be supplied to the combustor.

First Embodiment

FIG. 1 illustrates a configuration of a combustor for a gas turbine in accordance with a first embodiment, the combustor being equipped with a heat-transfer device on the inside surface of an air transfer casing 2. A combustor liner 1 and the air transfer casing 2 have a substantially concentric dual cylindrical construction while forming therebetween an annular passage through which air 5 or a heat-transfer medium flows, by making the diameter of the air transfer casing greater than that of the combustor liner. Vortex generating devices 10 for generating longitudinal vortices each having a rotational axis extending in the flow direction of the heat-transfer medium are installed in parallel to each other in the flow direction. The installation of the vortex generating devices in parallel mentioned here is as below. The vortex generating devices 10 are paired so that they have such elevation angles as to make the rotational directions of the vortices thus generated opposite to each other. Additionally, a plurality of the paired vortex generating devices are disposed in the circumferential direction of the inside of the air transfer casing at equal intervals so as to form a row. Lastly, the rows are installed adjacent to each other in the flow direction with their regular intervals maintained.

Figure 2:
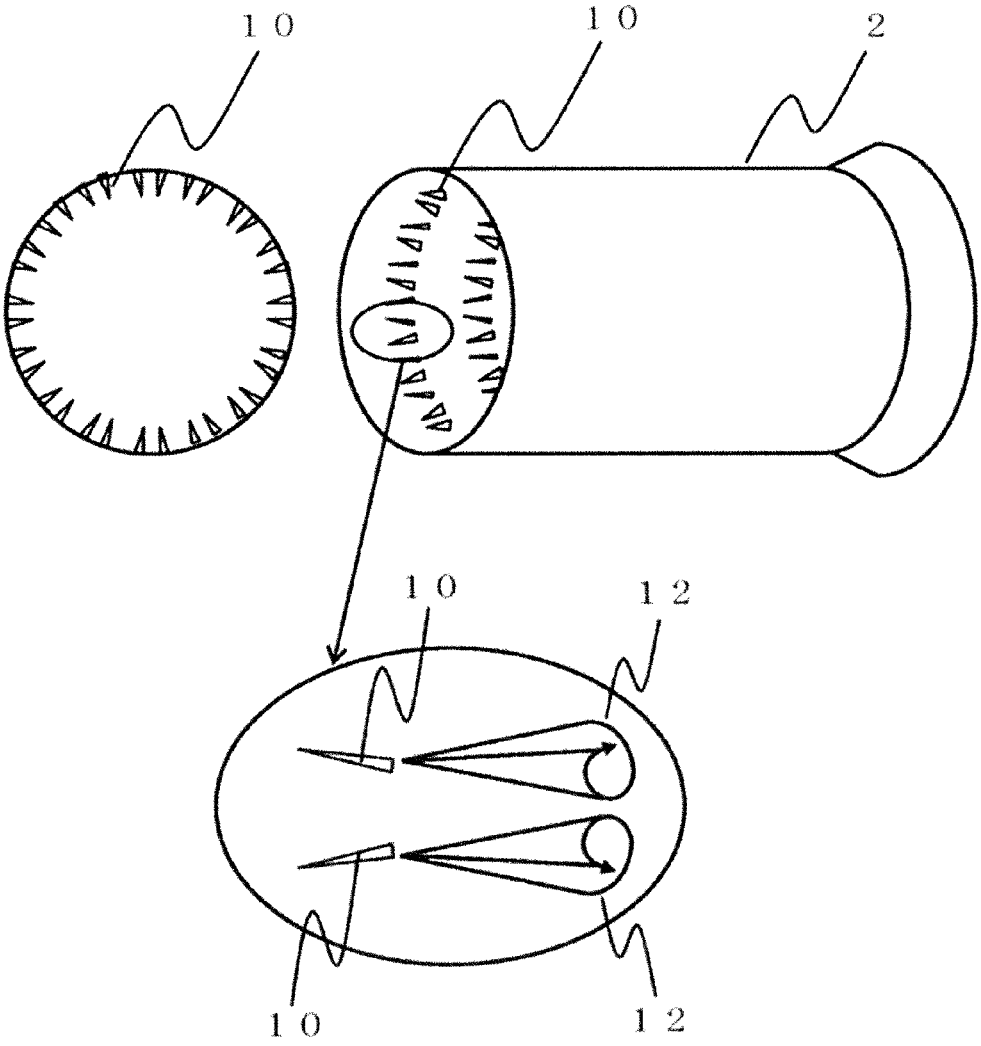
FIG. 2 illustrates the first embodiment having the heat-transfer device on the inside surface of the air transfer casing.

As illustrated in an enlarged detailed view in FIG. 2, the vortex generating device 10 is configured to form a pair in conjunction with the vortex generating device adjacent thereto. Additionally, the vortex generating devices 10 adjacent to each other are installed at such elevation angles as to make the rotational directions of the vortices thus generated opposite to each other. Further, the interval between the rows which each have the vortex generating devices and which are installed in parallel on the inside surface of the air transfer casing 2, is made to have a distance shorter than a distance where a vortex generated by the anterior vortex generating device disappears. Thus, the vortex generating devices are installed in such a manner that longitudinal vortices constantly exist in a clearance between the combustor liner 1 and the air transfer casing 2.

The vortex generating devices 10 by which the rotational directions of the vortices generated as above are opposite to each other are disposed as a pair. The longitudinal vortices which rotate inversely to each other interact with each other. The longitudinal vortices can efficiently be generated and held. Thus, sufficient cooling can be done with a small pressure loss, whereby an increase in pressure loss can be suppressed while improving product reliability. A plurality of the paired vortex generating devices are disposed in the circumferential direction of the air transfer casing at equal intervals so as to form a row. Lastly, a plurality of such rows are arranged in the flow direction, which makes it possible to cool the overall combustor liner effectively.

Figure 12:
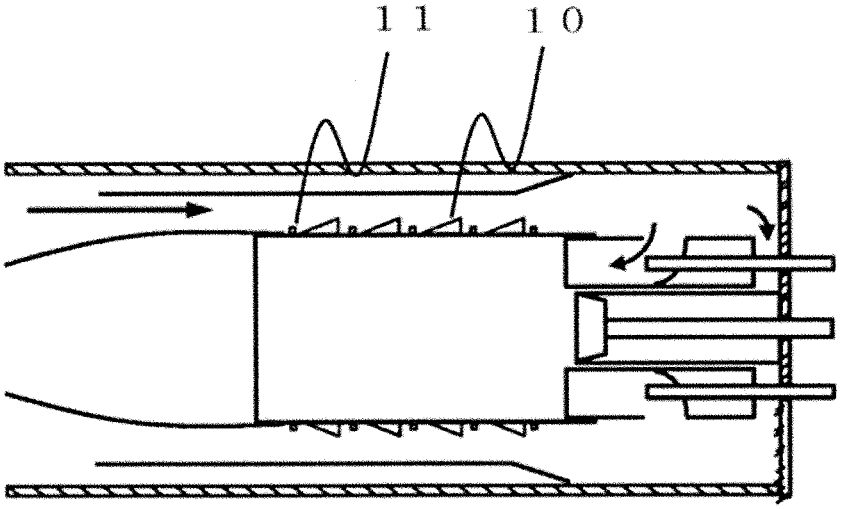
FIG. 12 is a cross-sectional view of a gas turbine combustor equipped with a conventional heat-transfer device.

FIG. 2 specifically illustrates the present embodiment in which the vortex generating devices 10 are installed on the inside surface of the air transfer casing 2. What is here illustrated is the individual vortex generating devices that are secured onto the inside surface of the air transfer casing 2 by welding or spot welding. A gas turbine combustor equipped with a conventional heat-transfer device is illustrated in FIG. 12 by way of example. The conventional heat-transfer device is characterized by including both vortex generating devices and turbulent flow enhancement devices on the outside surface of a combustor liner. In other words, the heat-transfer device is configured to be installed on the combustor liner side which is heated to high temperatures.

In contrast to this, the vortex generating devices 10 are installed on the inside surface of the air transfer casing 2 in the present embodiment. The merit of this configuration exists in suppression of increase in pressure loss while improving the reliability of a product as the gas turbine combustor equipped with the heat-transfer device. Additionally, since the vortex generating devices 10 are installed on the air transfer casing 2 which is located on a low-temperature member side, the welded portion of the vortex generating device has less thermal fatigue. Since the number of parts to be attached to the combustor liner is reduced, the number of welded portions can be reduced, which can achieve cost reduction and suppress the deformation of the combustor liner. In other words, unlike the combustor liner, the air transfer casing is used to define the annular passage through which a heat-transfer medium flows; therefore, it is always in a low-temperature state, that is, the air transfer casing requires no cooling. Thus, a material used for fabricating the air transfer casing may be an inexpensive material, such as carbon steel.

Further, since the vortex generating devices are installed on the air transfer casing side, the vortex generating devices, which are the heat-transfer device, can continuously be used as it is without replacement even if the combustor liner is replaced. The combustor liner, unlike the air transfer casing, has a main function to isolate high-temperature combustion gas 31 from air 5 which is a heat-transfer medium. Therefore, the combustor liner needs to be constantly cooled to a given temperature or lower. If deformation due to welding occurs in the combustor liner, a balance of cooling air loses locally, which probably leads to the burnout of the combustor liner due to lack of the amount of cooling air. However, in the present invention, the number of component parts to be mounted on the combustor liner is reduced to reduce the number of welding places. Thus, the deformation of the combustor liner can be suppressed, thereby improving product reliability.

Besides, JP-2000-320837-A describes "the effect of improving heat-transfer coefficient by increasing the velocity of the flow in the annular passage close to the combustion cylinder by means of only the guide fins installed on the external cylinder of the combustion cylinder". Specifically, the guide fins are intermittently installed on the inside surface of the air transfer casing at an angle of 30° to 60° relative to the mainstream direction. This narrows or reduces the sectional area of the annular passage to increase the velocity of passing air as a heat-transfer medium, thereby achieving an improvement of a heat-transfer effect, i.e., a cooling effect. However, the increase in flow velocity leads to an increase in pressure loss.

Focusing on the generating vortices, the configuration in which the guide fins are intermittently installed in the circumferential direction of the outside surface of the combustor liner illustrated in JP-2000-320837-A, is a configuration in which transverse vortices, i.e., planer vortices are generated on the surface of the combustor liner when a heat-transfer medium or air passes through a gap between both ends of the guide fins. These transverse vortices can break the boundary-layer on the surface of the combustor layer; therefore, the cooling effect can locally be improved. However, the transverse vortices, i.e., the planer vortices are gradually increased in temperature as they flow in the downstream direction, which gradually lowers the heat-transfer property, i.e., the cooling performance.

In contrast to this, since the vortex generating device 10 of the present embodiment has an angle of as acute as 10° to 20° relative to the mainstream direction, the sectional area of the inside of the annular passage is not substantially reduced, so that an increase in pressure loss can be suppressed. Further, the vortex generating devices installed in parallel constantly produce longitudinal vortices in the annular passage; therefore, the cool heat-transfer medium or air is stirred over the whole area of the passage, which prevents cooling property from being lowered.

Embodiment 2

Figure 3:
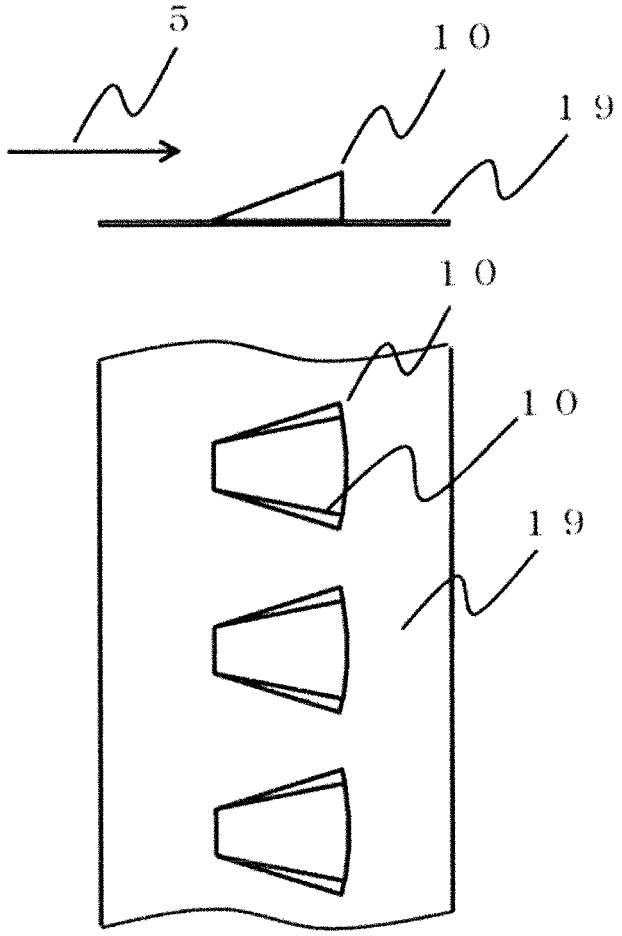
FIG. 3 illustrates a heat-transfer device provided with vortex generating devices formed on the surface of an attachment member by a forming process according to a second embodiment.
Figure 4:
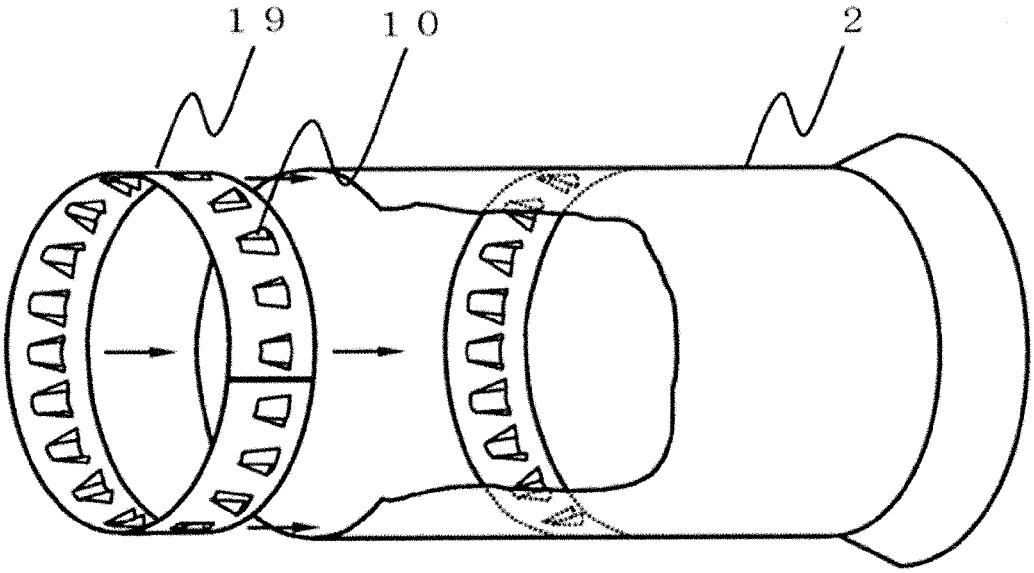
FIG. 4 illustrates the heat-transfer device of the second embodiment in which the vortex generating devices are formed in the attachment member, the attachment member is bent into a cylindrical shape and is inserted into the inner circumferential side of the air transfer casing.

FIG. 3 illustrates a configuration of a heat-transfer device according to a second embodiment. Vortex generating devices 10 which generate vortices each having a rotational axis extending in the flow direction of a heat-transfer medium are formed by an integral forming process on the surface of a sheet-like attachment member 19. Such an attachment member 19 formed with the vortex generating devices 10 is bent into a cylindrical shape. Thereafter, the cylindrical attachment member 19 is inserted into an air transfer casing 2 and secured by spot-welding to the inside surface of an air transfer casing 2, thus manufacturing a heat-transfer device. FIG. 4 illustrates a specific example in which the sheet-like attachment member 19 subjected to a forming process to manufacture the heat-transfer device is inserted into the inner circumferential side of the air transfer device.

A brief description is here given of a method for manufacturing the heat-transfer device with the vortex generating devices 10. The sheet-like attachment member 19 is subjected to the forming process by means of a pressing machine to form the vortex generating means 10 each having a given elevation angle relative to the flow direction. A plurality of the attachment members 19 each having the vortex generating devices 10 thus formed are installed in parallel in the flow direction. The vortex generating devices are formed to have such elevation angles that vortices generated by the vortex generating devices adjacent to each other have rotational directions opposite to each other.

According to this manufacturing method, the sheet-like attachment member 19 is subjected to an integral forming process to easily manufacture the heat-transfer device equipped with the vortex generating devices by making a die. Additionally, because of the simplified manufacturing method, a cost reduction can be achieved.

Embodiment 3

Figure 5:
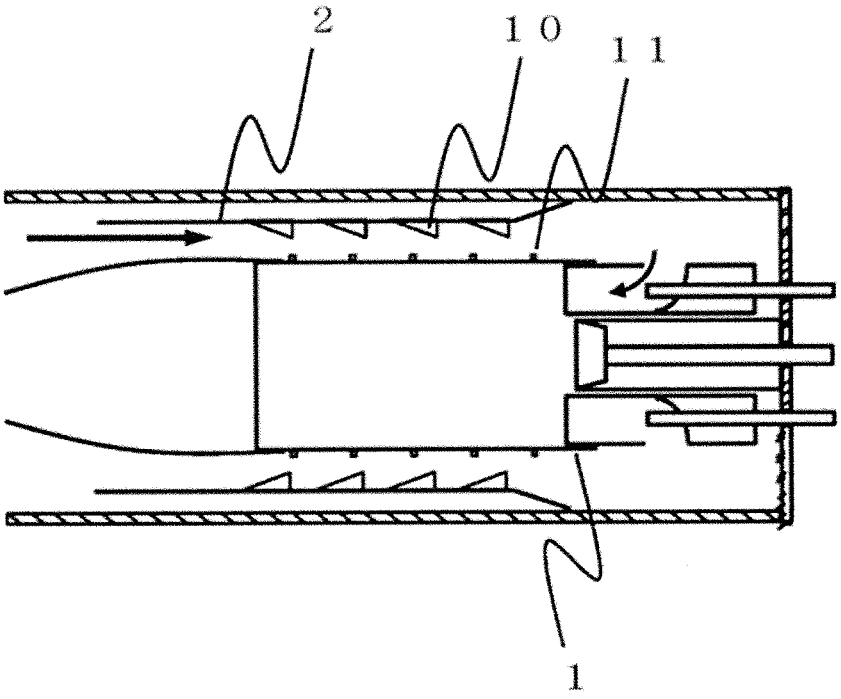
FIG. 5 is a cross-sectional view of a gas turbine combustor provided with turbulent-flow enhancement devices on the outside surface of a combustor liner according to a third embodiment.

FIG. 5 illustrates a configuration of a combustor equipped with a heat-transfer device according to a third embodiment. Specifically, turbulent-flow enhancement devices 11 are installed on the outside surface of a combustor liner 1. The turbulent flow enhancement devices 11 installed to intersect the flow direction of a heat-transfer medium act to generate separation vortices close to the wall surface of the combustor liner 1. Unlike the vortices generated by the vortex generating devices, these separation vortices do not have such an effect of largely stirring the heat-transfer medium in the overall passage; however, they have a large effect of breaking the boundary-layer close to the wall surface of the combustor liner. Thus, the turbulent-flow enhancement devices 11 in conjunction with the vortex generating devices 10 installed on the inside surface of the air transfer casing can increase a cooling enhancement effect in a synergistic manner.

This is because the separation vortices formed by the turbulent-flow enhancement devices 11 break the boundary-layer close to the wall surface of the combustor liner, so that the cool air carried by longitudinal vortices from the air transfer casing 2 side can effectively be used to cool the combustor liner 2. According to the configuration of the present embodiment concurrently including the vortex generating devices 10 and the turbulent flow enhancement devices 11 which are installed on the outside surface of the combustor liner so as to break the boundary-layer occurring in the heat-transfer medium, it is possible to further improve cooling efficiency. Therefore, an effect of improving product reliability and an effect of suppressing an increase in pressure loss can be provided more remarkably.

Embodiment 4

Figure 6:
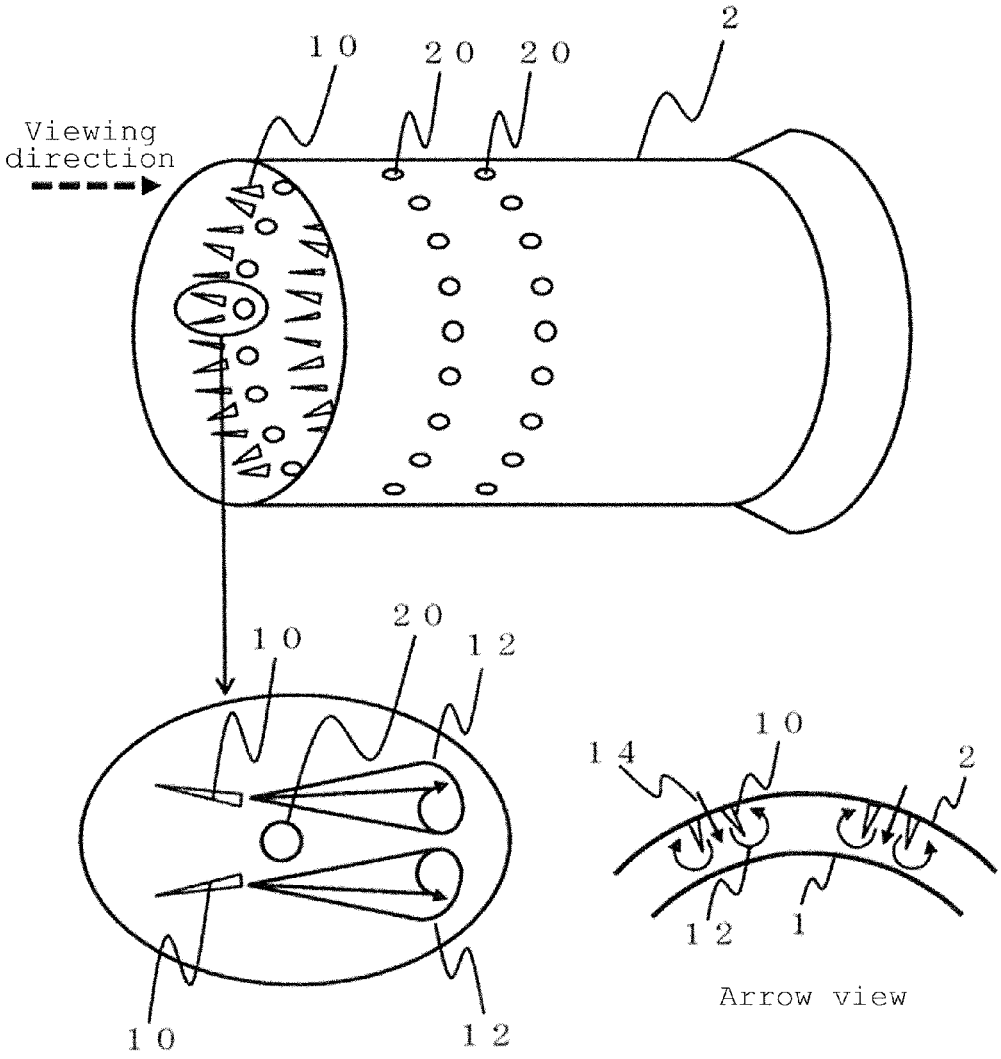
FIG. 6 illustrates a fourth embodiment in which impingement jet cooling holes are formed in an air transfer casing provided with a heat-transfer device.

FIG. 6 illustrates a configuration of a combustor equipped with a heat-transfer device according to a fourth embodiment. Specifically, an air transfer casing 2 equipped with vortex generating devices 10 on the inside surface thereof is formed with impingement jet cooling holes 20. These impingement jet cooling holes 20 are located on the downstream side of the vortex generating devices 10. That is to say, in an area on the downstream side of and just behind the vortex generating devices 10, a region may exist where a sufficient stirring effect resulting from the longitudinal vortexes cannot be produced since longitudinal vortexes 12 flow with gradual development. To eliminate this, the impingement jet cooling holes 20 are formed on the downstream side of and just behind the vortex generating devices 10. This produces an effect of allowing the heat-transfer medium flowing from the impingement jet cooling holes 20 to press the longitudinal vortices 12 toward the combustor liner in a short distance without breaking the longitudinal vortex 12. Thus, the whole region of the combustor liner can effectively be cooled.

That is to say, as illustrated in an enlarged detailed view of FIG. 6, the longitudinal vortex 12 that is sufficiently be developed is not generated in the region on the downstream side of and just behind the vortex generating devices 10. Therefore, because of small stirring action, a convective cooling effect cannot be produced. Thus, the present embodiment has the impingement jet cooling hole 20 formed in the region on the downstream side of and just behind the vortex generating devices 10. This intends to improve the cooling effect by being combined with the impingement jet cooling of the impingement jet cooling hole 20. According to the configuration of the present embodiment, the region, which is located on the downstream side of and just behind the vortex generating device and in which the developed vortex does not occur, can be cooled by the impingement jet cooling. Thus, product reliability can be improved.

In comparison with the conventional cooling configuration using impingement jet cooling, the configuration of the present embodiment can realize sufficient cooling performance without the formation of the immoderately increased number of the impingement jet cooling holes 20, by the synergetic effect with the longitudinal vortices formed by the vortex generating devices 10. Thus, an increase in pressure loss can be suppressed.

Further, as illustrated in an arrow view of FIG. 6, the impingement jet cooling hole 20 is arranged so that the jet direction of the jet flow 14 of the heat-transfer medium flowing from the impingement jet cooling hole 20 may not oppose to the rotational directions of the longitudinal vortices 12 formed by the paired vortex generating devices 10. Thus, the longitudinal vortex 12 can be reinforced by the jet flow 14 of the heat-transfer medium flowing from the impingement jet cooling hole 20. Additionally, the low-temperature heat-transfer medium flowing from the impingement jet cooling hole 20 can be taken in the longitudinal vortices 12. This can further improve the cooling performance. Thus, while improving product reliability, an increase in pressure loss can be suppressed.

Embodiment 5

Figure 7:
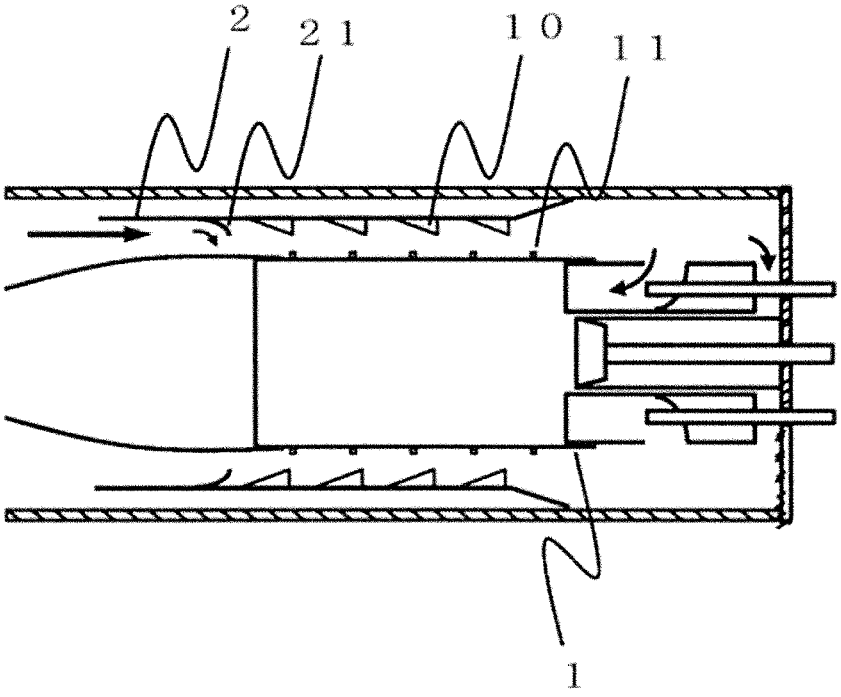
FIG. 7 is a cross-sectional view of a gas turbine combustor equipped with inward guide vanes on the inside surface of an air transfer casing according to a fifth embodiment.

FIG. 7 illustrates a configuration of a combustor equipped with a heat-transfer device according to a fifth embodiment. Specifically, inward guide vanes 21 are installed on the inside surface of an air transfer device 2 at a position in front of, i.e., on the upstream side of, first-stage of vortex generating devices. The inward guide vane 21 is adapted to forcibly change the direction of flow of a heat-transfer medium to an internal circumferential direction, i.e., to an inward direction. The inward guide vanes 21 supply a portion of the flow of a low-temperature heat-transfer medium toward the surface of the combustor liner.

The inward guide vanes 21 and the vortex generating devices 10 are concurrently used in a local region that particularly needs a cooling effect. This can effectively improve the cooling of the combustor liner 1. The inward guide vane 21 increases a pressure loss because it has fluid resistance greater than that of the vortex generating device. However, the inward guide vanes 21 forcibly change the direction of flow of the heat-transfer medium; therefore, the overall combustor liner can effectively be cooled.

Figure 8:
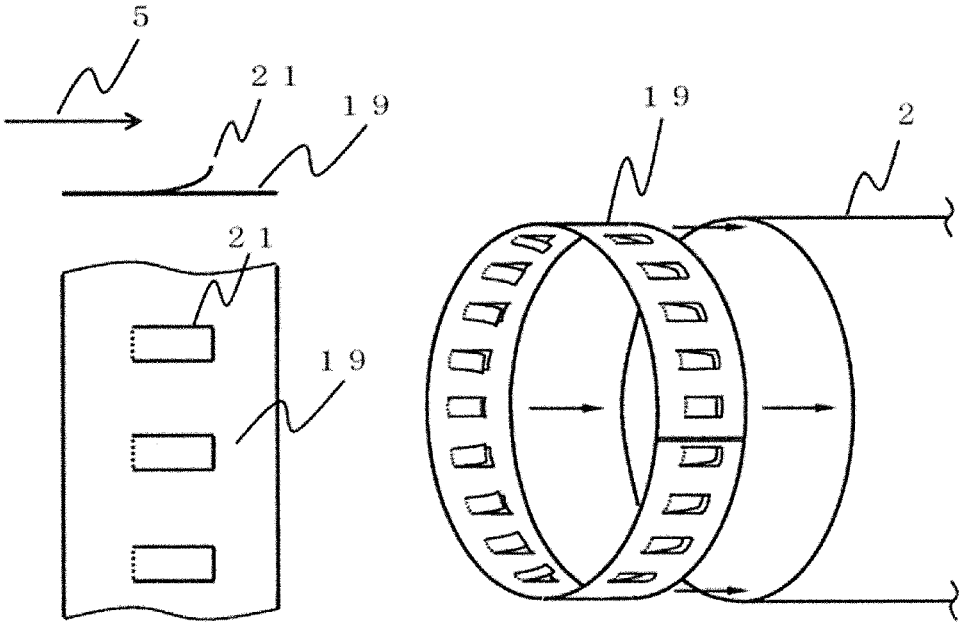
FIG. 8 illustrates a heat-transfer device according to the fifth embodiment in which inward guide vanes are formed in the front surface of an attachment member, and the attachment member is bent into a cylindrical shape and is inserted on the inner circumferential side of the air transfer casing.

FIG. 8 illustrates a specific example in which a sheet-like attachment member 19 subjected to a forming process to manufacture the heat-transfer device is inserted in the inner circumferential side of the air transfer casing 2. The inward guide vanes 21 which change the direction of flow of the heat-transfer medium to the internal circumferential direction, i.e., to an inward direction are formed on the surface of the sheet-like attachment member 19 by an integral forming process. Such an attachment member 19 is bent into a cylindrical shape. Thereafter, the cylindrical attachment member 19 is inserted into the inner circumferential side of the air transfer casing 2 and secured by spot-welding to the inside surface thereof, thus manufacturing a heat-transfer device. By making a die, this manufacturing method can subject the sheet-like attachment member 19 to an integral forming process so as to form the inward guide vanes 21 easily. Additionally, because of the simplified manufacturing method, a cost reduction can be achieved.

Embodiment 6

Figure 9:
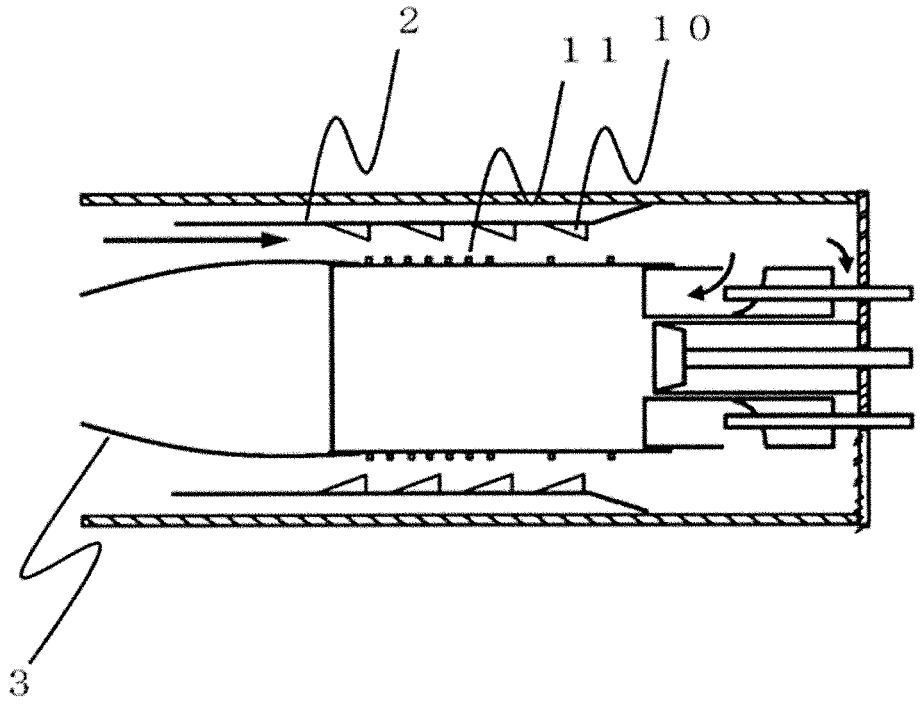
FIG. 9 is cross-sectional view of a gas turbine combustor according to a sixth embodiment in which a large number of turbulent-flow enhancement devices are installed at narrow intervals on the outside surface of the combustor liner.

FIG. 9 illustrates a configuration of a combustor equipped with a heat-transfer device according to a sixth embodiment, which relates to the heat-transfer device of the third embodiment. Vortex generating devices 10 are installed on the inside surface of the air transfer casing 2. This provides an advantage of increasing the flexibility of the number of turbulent-flow enhancement devices 11 installed on the outside surface of a combustor liner and the flexibility of intervals between the lines of the turbulent flow enhancement devices 11. Therefore, it is possible to install a larger number of the turbulent-flow enhancement devices 11 at narrower intervals on the surface of the downstream side region of the combustor liner, i.e., on the side of the transition piece 3, where cooling is intended to be increased, than on the other regions.

These turbulent-flow enhancement devices 11 have a large effect of breaking the boundary-layer close to the wall surface of the combustor liner. Therefore, combination use with the vortex generating devices 10 installed on the inside surface of the air transfer casing further increases a cooling enhancement effect.

Embodiment 7

Figure 10:
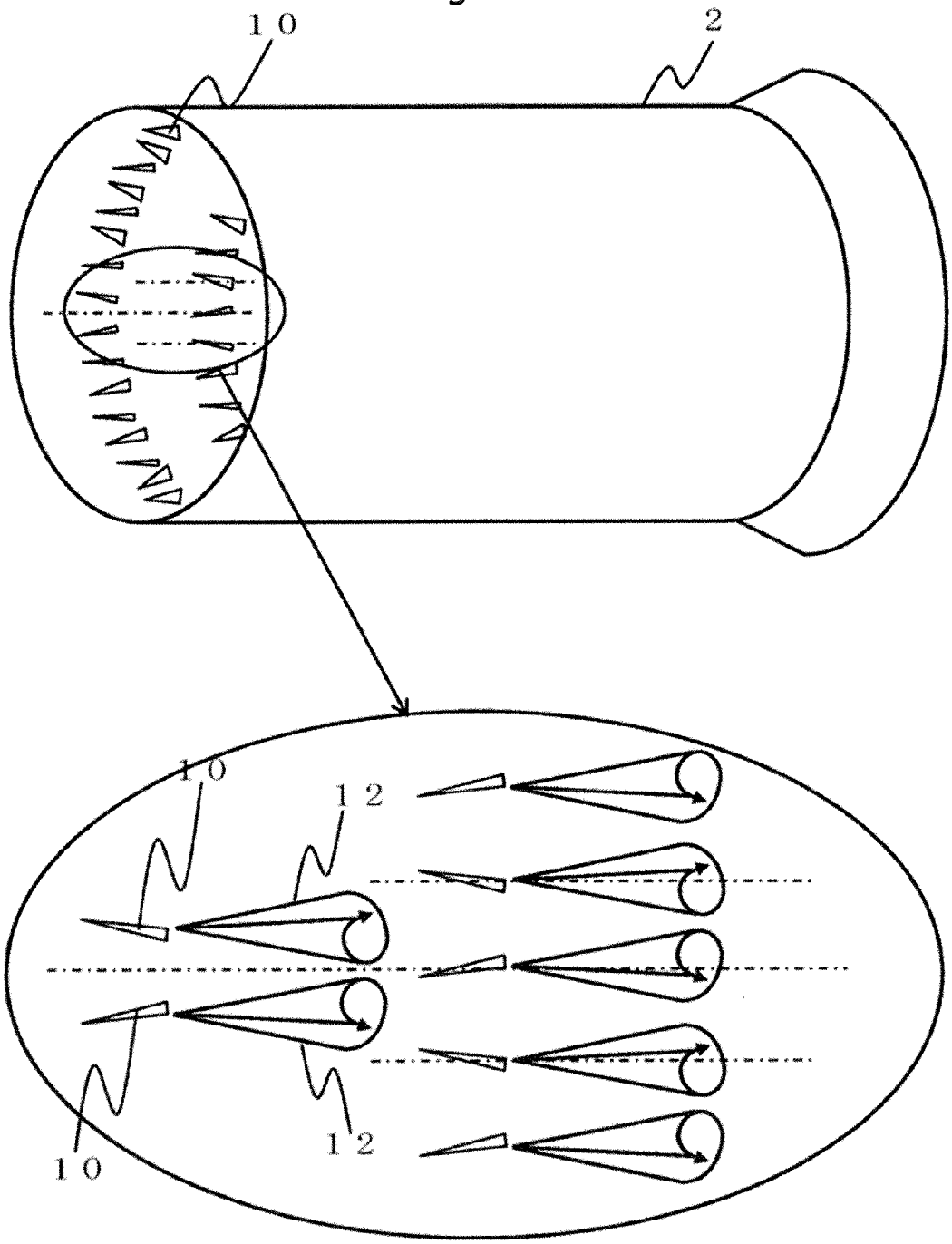
FIG. 10 illustrates a gas turbine combustor equipped with a heat-transfer device according to a seventh embodiment in which vortex generating devices forming rows installed in parallel to each other on the inside surface of an air transfer casing are changed in installation phase for each row.
Figure 11:
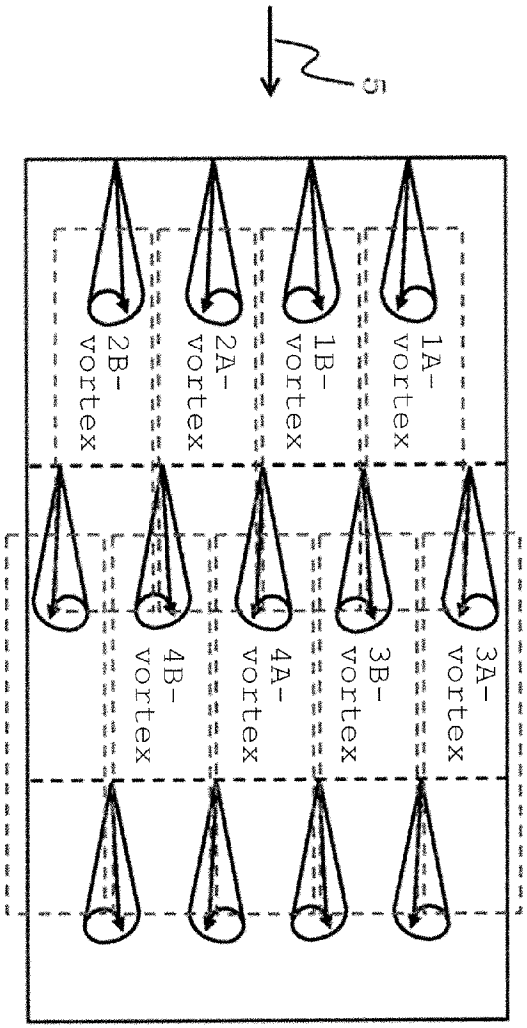
FIG. 11 illustrates the streamlines of longitudinal vortices generated by changing the installation phase of the vortex generating devices for each row.

FIG. 10 illustrates a configuration of a combustor equipped with a heat-transfer device according to a seventh embodiment, which relates to the first embodiment. Specifically, vortex generating devices 10 forming rows installed in parallel to each other on the inside surface of an air transfer casing 1 are installed such that their installation phase are changed for each row. More specifically, as illustrated in FIG. 11, the vortex generating devices are installed such that their phases are different from each other between anterior and posterior rows. By doing so, longitudinal vortexes generated by the upstream side longitudinal vortex generating devices are sucked into the longitudinal vortices generated by the downstream side longitudinal vortex generating devices. This produces a stirring effect, which enlarges a cooling performance region on the wall surface of the combustor liner.

According to the configuration of the present embodiment, a pair of longitudinal vortices, a 1A-vortex and a 1B-vortex, generated by the upstream side longitudinal vortex generating devices flows toward the downstream side. Before long, the pair of longitudinal vortices is sucked in and stirred by a 3B-vortex generated by the downstream side vortex generating device. This action repeats for each row of the vortex generating devices as the longitudinal vortices flow downstream. Therefore, the longitudinal vortices different in phase from each other are formed in the annular passage. This produces a larger stirring effect, thereby improving an effect of cooling the combustor liner.

What is claimed is:

1. A gas turbine combustor comprising:

a combustor liner;

an air transfer casing disposed on an outer circumference side of the combustor liner, the combustor liner and the air transfer casing defining an annular passage therebetween adapted to allow a heat-transfer medium to flow therethrough; and a plurality of vortex generating devices disposed on an inside surface of the air transfer casing, the vortex generating devices each generating longitudinal vortices each having a rotational axis extending in a flow direction of the heat-transfer medium;

wherein the plurality of vortex generating devices are arranged in a paired manner, with each pair of vortex generating devices generating the vortices so that the vortices have rotational directions opposed to each other; and wherein each of a plurality of impingement jet cooling holes is formed in the air transfer casing downstream of the vortex generating devices with respect to the flow of the heat-transfer medium, is disposed between paired devices of the vortex generating devices corresponding to the impingement jet cooling hole, and is positioned so that a direction of a jet flow of the heat transfer medium flowing from the impingement jet cooling hole does not oppose rotation of the longitudinal vortices formed by the paired vortex generating devices.

2. The gas turbine combustor according to claim 1, further comprising a plurality of turbulent-flow enhancement devices, which break a boundary-layer occurring in the air-transfer medium on an outside surface of the combustor liner disposed in an axial direction of the combustor liner.

3. The gas turbine combustor according to claim 2, wherein some of the turbulent-flow enhancement devices are arranged at narrower intervals in one area than in the other area.

4. The gas turbine combustor according to claim 1, wherein the vortex generating devices arranged in the paired manner are arranged in a circumferential direction of the air transfer casing to form a row, and wherein said row is one of a plurality rows arranged in an axial direction of the air transfer casing.

5. The gas turbine combustor according to claim 4, wherein the vortex generating devices arranged in the plurality of rows are installed so that the vortex generating devices are shifted in the circumferential direction in adjacent rows.

6. The gas turbine combustor according to claim 1, further comprising an inward guide vane, which forcibly changes the direction of the jet flow of the heat-transfer medium to an inner circumferential direction, disposed on an inside surface of the air transfer casing on an upstream side of the vortex generating device in the flow direction of the heat-transfer medium.

7. The gas turbine combustor according to claim 1, further comprising an inward guide vane, which forcibly changes the direction of the jet flow of the heat-transfer medium to an inner circumferential direction, formed in the surface of an attachment member, wherein the attachment member is bent into a cylindrical shape and received in an inner circumferential side of the air transfer casing.

8. The gas turbine combustor according to claim 1, wherein the vortex generating devices are formed in an attachment member, the attachment member is bent into a cylindrical shape, and the attachment member is received in an inner circumferential side of the air transfer casing.

* * * * *